US007967545B2

(12) United States Patent
Lauvdal

(10) Patent No.: US 7,967,545 B2
(45) Date of Patent: Jun. 28, 2011

(54) LIFTER DEVICE FOR DISPLACEMENT OF AN ARTICLE

(75) Inventor: Olav Lauvdal, Marnardal (NO)

(73) Assignee: Ugland & Lauvdal AS, Marnadal (NO)

( * ) Notice: Subject to any disclaimer, the term of this patent is extended or adjusted under 35 U.S.C. 154(b) by 808 days.

(21) Appl. No.: 10/562,632

(22) PCT Filed: Jun. 29, 2004

(86) PCT No.: PCT/NO2004/001196

§ 371 (c)(1),
(2), (4) Date: Mar. 22, 2006

(87) PCT Pub. No.: WO2005/000730

PCT Pub. Date: Jan. 6, 2005

(65) Prior Publication Data

US 2006/0182586 A1 Aug. 17, 2006

(30) Foreign Application Priority Data

Jun. 30, 2003 (NO) ..... 20033009
Aug. 13, 2003 (NO) ..... 20033598

(51) Int. Cl.
*B66F 9/18* (2006.01)

(52) U.S. Cl. ..... 414/607

(58) Field of Classification Search ..... 414/607; 284/65.5

See application file for complete search history.

(56) References Cited

U.S. PATENT DOCUMENTS

| | | | | | |
|---|---|---|---|---|---|
| 2,713,431 | A * | 7/1955 | Koehler | 414/422 |
| 2,929,523 | A | 3/1960 | Cushman | |
| 3,014,751 | A * | 12/1961 | Smith | 294/65.5 |
| 3,115,262 | A | 12/1963 | Avrey | |
| 3,881,617 | A * | 5/1975 | Miller et al. | 414/422 |
| 4,334,820 | A * | 6/1982 | Homura | 414/607 |
| 4,348,055 | A * | 9/1982 | Meisner et al. | 298/23 DF |
| 4,753,568 | A * | 6/1988 | Langenfeld et al. | 414/703 |
| 4,789,295 | A * | 12/1988 | Boucher et al. | 414/497 |
| 5,066,936 | A * | 11/1991 | Hsu | 335/295 |
| 5,516,254 | A | 5/1996 | Gessler | |
| 5,590,839 | A * | 1/1997 | Condrey | 241/27 |
| 6,024,529 | A | 2/2000 | Kristensen | |
| 6,471,273 | B1 * | 10/2002 | Friedrich et al. | 294/65.5 |
| 6,715,980 | B2 * | 4/2004 | Bouthillier | 414/642 |
| 6,796,602 | B2 * | 9/2004 | Hagenbuch | 296/186.3 |
| 2005/0269827 | A1 * | 12/2005 | Heard | 294/65.5 |

FOREIGN PATENT DOCUMENTS

GB 1406036 9/1975

* cited by examiner

*Primary Examiner* — Charles A Fox
(74) *Attorney, Agent, or Firm* — Christian D. Abel

(57) ABSTRACT

A device for mounting on an implement carrier such as a fork lift truck, hoisting crane or the like in order to move, hold or lift an object. The device comprises—a carrier part which is mounted on the implement carrier preferably by the carrier part being in the form of a sleeve which is inserted on the implement carrier's fork structure, and—a holding part which is attached to the carrier. part, the holding part being provided with at least one securing device with characteristics that make it possible to secure an object by contact between at least one of the object's surfaces and the securing device, —a trigger that ensures that the forces acting between the object's surface and the securing device are broken or discontinued, thus releasing the object.

6 Claims, 3 Drawing Sheets

LIFTER DEVICE FOR DISPLACEMENT OF AN ARTICLE

The present invention is a National Stage application under 35 USC §351 of PCT-application PCT/NO04/00196, filed Jun. 29, 2004, which claims priority from the Norwegian patent applications 20033009 filed on Jun. 30, 2003, and 20033598 filed on Aug. 13, 2003.

BACKGROUND OF THE INVENTION

The invention relates to a holding device for mounting on an implement carrier such as a fork lift truck, hoisting crane, tractor or the like in order to move, hold or lift an object.

The object of the invention is to provide a device which can be used in connection with moving or holding an object, where only one of the object's surfaces is accessible as a gripping/lifting surface.

Such a device will be particularly useful where several objects are stacked on top of one another in such a fashion that it is difficult or even impossible to obtain a conventional, encircling grip of the individual object, since only one of the object's surfaces is accessible as a possible gripping surface.

The device according to the invention will therefore be suitable for a range of applications, but will be particularly relevant in connection with moving discarded white goods. In the course of time the demand has increased for recycling or special treatment of white goods such as refrigerators and cookers, resulting in an accumulation of white goods at the dealers' receiving stations. The white goods are often tightly stacked on top of one another in great quantities. For refuse disposal companies that have to collect the white goods and depend on fast removal of the discarded white goods, it is a major challenge to have the tightly-stacked white goods transferred to the lorry in a fast and efficient manner. Standard implement carriers such as fork lift trucks are not suited to this purpose, since there is often little or no room for the truck's gripping parts due to the tight stacking.

Thus there is a great need to provide a device which is designed so as to permit the transfer of the object even though only one of the object's surfaces/sides is accessible as a gripping surface. When the device has to be employed in connection with moving an item of white goods, for example, one of the sides or the top surface of the item viewed in relation to the individual item's position in the stack may be relevant gripping surfaces for the device.

Such an invention is provided by the device as it is set out in the independent patent claim. Further embodiments of the invention are set out in the following dependent patent claims.

BRIEF SUMMARY OF THE INVENTION

The device according to the invention comprises:

A carrier part which is mounted on the implement carrier preferably by the carrier part being in the form of a sleeve that is inserted in suitable parts of the implement carrier. For example, a fork structure such as a truck's fork will be well suited for mounting the carrier part. The device further comprises a holding part which, for example, may be attached to the carrier part in a substantially vertical orientation. The holding part is provided with at least one securing device with characteristics that enable it to secure an object by contact between at least one of the object's surfaces and the securing device. The holding forces from the securing device(s) thereby essentially provide the holding capacity for the device according to the invention. The size of the securing device's contact surface is adapted to suit the specific tasks.

A trigger which is included in the device breaks the forces between the object's surface and the securing device, thus releasing the object from the holding device.

With the device a grip can therefore be established between one of the surfaces of the object that has to be moved and the actual device. The device in question with the object secured can be moved to the desired location and the trigger can be employed to release the object at the new location.

According to a preferred embodiment of the invention the object that has to be moved, held or lifted is an object with a surface that has at least some smooth portions or an object that is composed of thin metal sheets, for example of the white goods type. It should be mentioned here that other types of objects such as cardboard boxes, windows, building surfaces may be suitable objects for the device according to the invention to move, hold or lift.

If the object that has to be moved/held is composed of thin metal sheets and/or is an item of white goods such as a refrigerator, washing machine, etc., the securing device may be comprised of one or more electromagnets or permanent magnets, or a combination thereof.

Alternatively, the securing device may be composed of suction cups or similar devices that can create negative pressure. Equipped with suction cups with negative pressure, the invention will be able to be used for installation of, for example, windows, window panes and wallboards. By means of a vacuum generator that generates negative pressure in the suction cups, sufficient holding power is developed for the various objects that have to be handled. The size and number of suction cups and their nature and design will vary according to what has to be lifted or handled. An energy-saving function is mounted on the vacuum system in order to reduce the energy consumption since the yoke is mainly built for mobile use.

When installing objects such as window panes or wallboards, it will be possible to remove them from the top lying in a horizontal position. When they are securely gripped by vacuum suction cups, the board or window pane can be swung into the desired position either manually or by means of an actuator. The actuator may, for example, be a pneumatic, hydraulic or electric actuator. The objects are then transported to the mounting point. They are driven by vacuum ejectors (compressed air-driven vacuum pumps) and in addition a vacuum generator with associated control systems is mounted. The size of the latter depends on the air consumption and the user's requirement regarding how many lifts should be performed before recharging the compressed air tank. The compressed air tank may also be connected to a compressor for continuous operation. The compressor may be driven by an electromotor with its own batteries mounted on the yoke, or by an internal combustion engine or a hydraulic motor. It is also possible to mount electrically-operated vacuum pumps on each suction cup.

In an embodiment the trigger employed for releasing the object may be a guide part which is rotatably mounted in the holding part. The guide part is rotated, thus pushing the object away from the securing device by means of the rotating motion to a distance that is sufficient for the forces between the object and the securing device to decrease and the object is released from the holding device. When using permanent magnets, the guide part pushes the object away from the contact surface, with the result that the object is moved beyond the permanent magnets' effective range of influence. Alternatively, the trigger may be designed so as to break the voltage to the electromagnets by interrupting the current supply, thus causing the magnets to lose their holding power, or causing the negative pressure to be discontinued, thus releasing the object.

In a second embodiment the trigger may be a spring-loaded device which causes the distance between the securing device and the object to increase, thus releasing the object. A spring-loaded device of this kind can be stretched by a hydraulic force, for example from an actuator or by the forks of a fork lift truck being moved from one position to another. When the forks are in a projecting position the trigger may be in a position where the object is released, or the trigger may be in a position where the object is secured.

If the device according to the invention is attached to an implement carrier such as a truck or the like with telescopable fork, a fixed connection can be established, such as, for example, a securely connected line between a stationary part of the fork and the guide part. When the fork is fully extended telescopically, this will cause the guide part to be rotated and the object released. Alternatively, in addition to the line, the guide part may be provided with a spring element. In an embodiment of the invention the guide part will be rotated and the object released when the forks are in a retracted state. When the forks are telescoped outwards towards a projecting position, the line and spring element arrangement will ensure that the guide part is held in a position where the object is secured relative to the securing device. This will be described in greater detail in the detailed description of the figures.

Alternatively, the trigger may be operated manually or by means of an actuator. The actuator may, for example, be a pneumatic, hydraulic or electric actuator.

As additional equipment one or more supporting edges may be permanently or removably mounted in the lower edge of the holding part. The supporting edge may be employed as an extra holding/lifting device in addition to the holding force from the securing devices. If there is no room for the supporting edge due to the size of the object that has to be lifted, the supporting edge can be removed. The resulting reduction in holding force is compensated by increased holding force from the securing device, for example in the form of an augmented magnetic field. A stronger or augmented magnetic field is achieved by means of more or stronger magnets.

The holding part may be rotatably or preferably hingedly mounted on the carrier part, thus enabling the holding part to be moved to another desired position and fixed in this new position. In an embodiment the holding part is oriented in a vertical position so that the securing device's contact surface is standing in a vertical position, but the holding part can also be moved forwards to a horizontal position in order to be able to grip surfaces from the top.

The device according to the invention can be designed to be collapsible. Thus the device may, for example, be folded up by the holding part being moved backwards to abut against the carrier part.

BRIEF DESCRIPTION OF THE DRAWINGS

A preferred embodiment of the invention will now be described in detail in association with the figures.

DETAILED DESCRIPTION OF THE INVENTION

In FIGS. 1-4 the device is illustrated with a carrier part 2 fitted over a fork structure 9 which may belong to a hoisting crane, fork lift truck, tractor or other implement carrier. It can be seen in the figures that the carrier part 2 is in the form of one or more sleeves inserted in the fork structures. A holding part 6 is shown mounted at the end of the carrier part 2 and in addition securing devices 1 in the form of magnets are affixed to the holding part 6.

Figure 1:
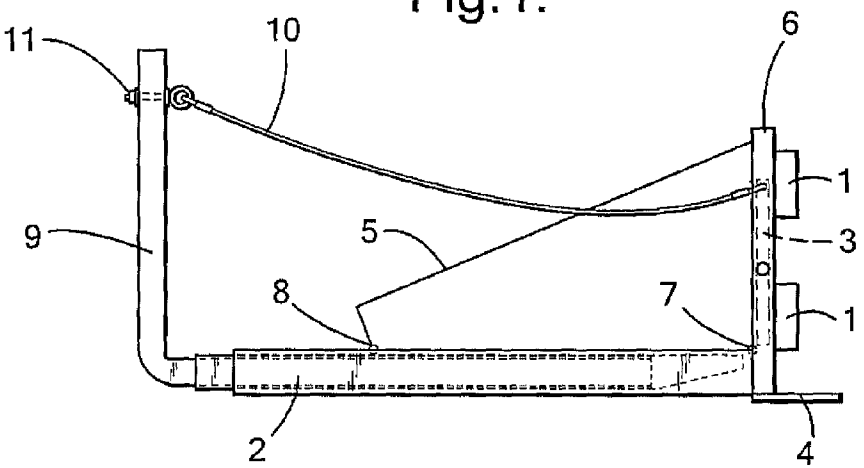
FIG. 1 is a side view of the device according to an embodiment of the invention.
Figure 2:
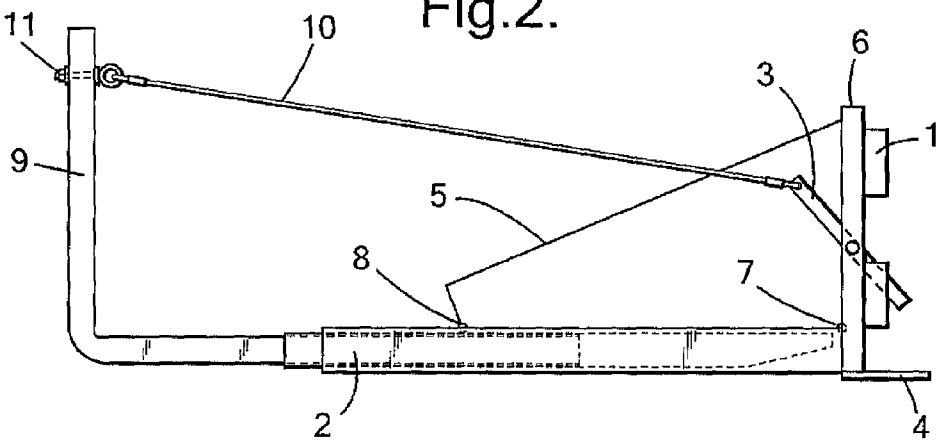
FIG. 2 also views the device from the side, in this case with the trigger moved into a rotated position.

One or more magnets 1 create a magnetic field with a field strength which is such that the forces acting on the object concerned are sufficient to enable the object to be held, lifted and moved. In FIGS. 1-4 the device is equipped with five magnets. The trigger is illustrated here as a guide part 3 in the form of a hinged lever arm which by means of an actuator distances the object in order to achieve release of the object from the magnets 1. In FIG. 1 the guide part 3 is illustrated in a retracted position and in FIG. 2 the guide part 3 is illustrated in projecting position. As can be seen in FIGS. 1 and 2 the actuator employed for rotating the guide part 3 is composed of a telescopable fork structure. A line 10 is attached to a stationary part of the fork structure 9 by means of a bolt 11. When the fork structure is telescoped outwards, the line will be tightened, thereby causing the guide part 3 to be rotated to a position where an object can be released from the magnets 1.

One or more removable holding edges 4 for extra holding force may be mounted on the holding part 6. The holding edge(s) are designed according to requirements. The holding part 6 may be fixed or suspended in a hinge point 7. If objects require to be lifted from their top surface, the holding part 6 can be swung forwards to a horizontal or other desired position and locked in the desired position. The holding part 6 is illustrated here connected to the carrier part 2 by a hinge 7 in the lower edge. A support structure 5 may furthermore be connected to the holding part 6 and the carrier part 2. The support structure 5 may be attached at the lower edge by a hinge 8 to the carrier part 2.

Figure 3:
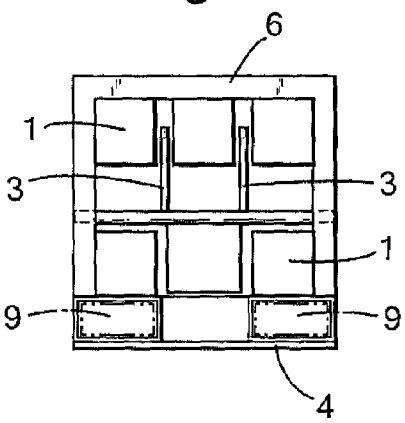
FIG. 3 is a front view of the holding part with securing devices.
Figure 4:
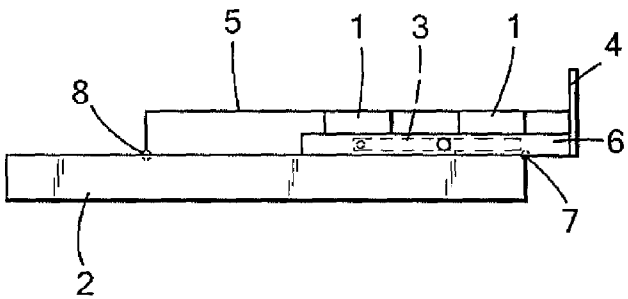
FIG. 4 illustrates the device in a folded position.

As illustrated in FIG. 4 the device can be folded up by releasing the connection between the support structure 5 and the holding part 6. The holding part 6 is then laid backwards into a lying position. The support structure 5 is then laid forwards and will lie on top of the holding part 6. On the support structure 5 there may be mounted a protective device which in a folded position will cover the magnet(s) 1 on the holding part 6.

Figure 5:
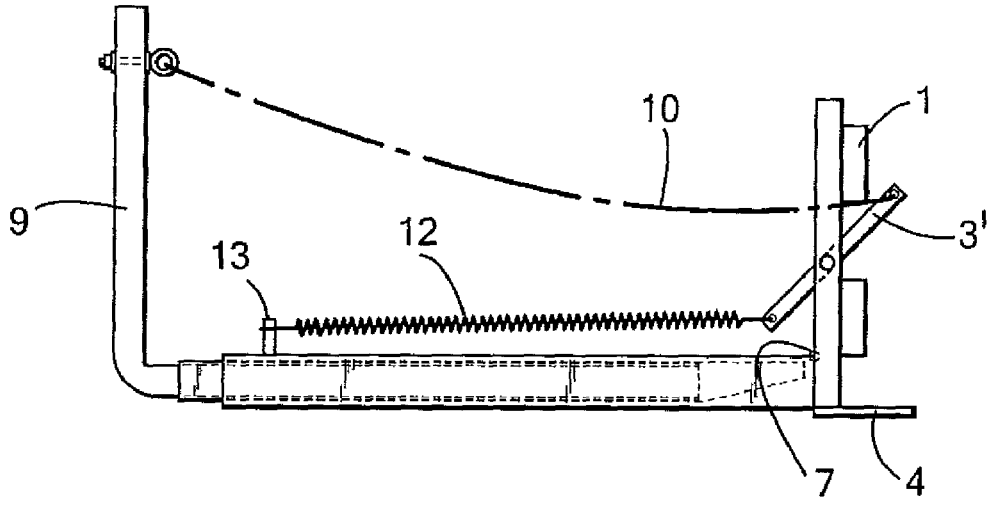
FIGS. 5-8 illustrate an alternative embodiment of the device.
Figure 6:
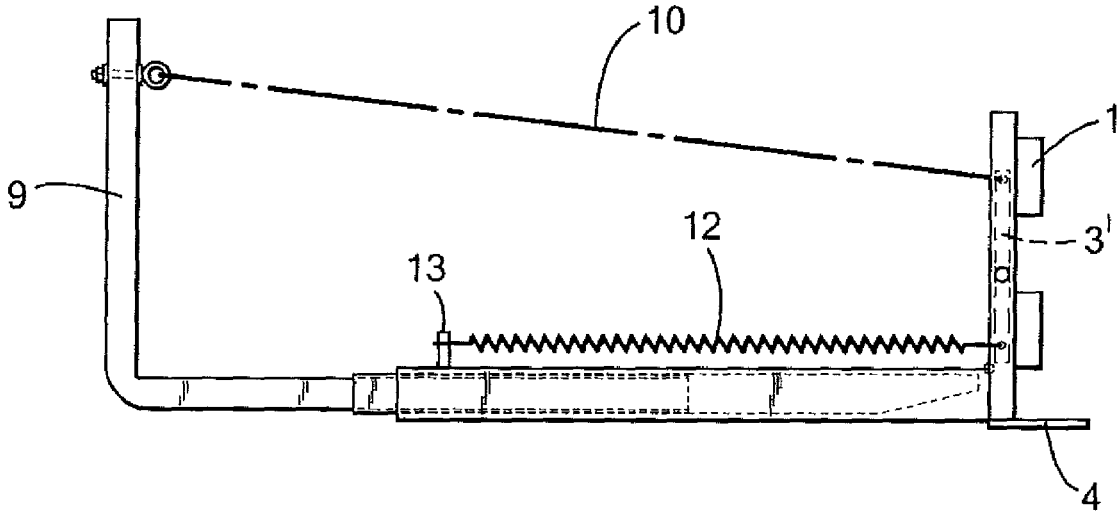

FIGS. 5 and 6 illustrate a principle for alternative rotation of the trigger 3. The device is composed of components corresponding to those illustrated in FIGS. 1-4, but in addition is equipped with a spring 12 attached to a point 3' on the guide part 3 and to a holder 13 attached to the carrier part 2. In FIG. 5 the forks are illustrated in a retracted state, the spring 12 has pulled the trigger 3 into a position where an object that is fixed to the magnets 1 will be released. In FIG. 6 the forks are illustrated telescoped outwards, the line 10 is taut, the spring is stretched and the guide part 3 is located in a position where the object is still secured.

Figure 7:
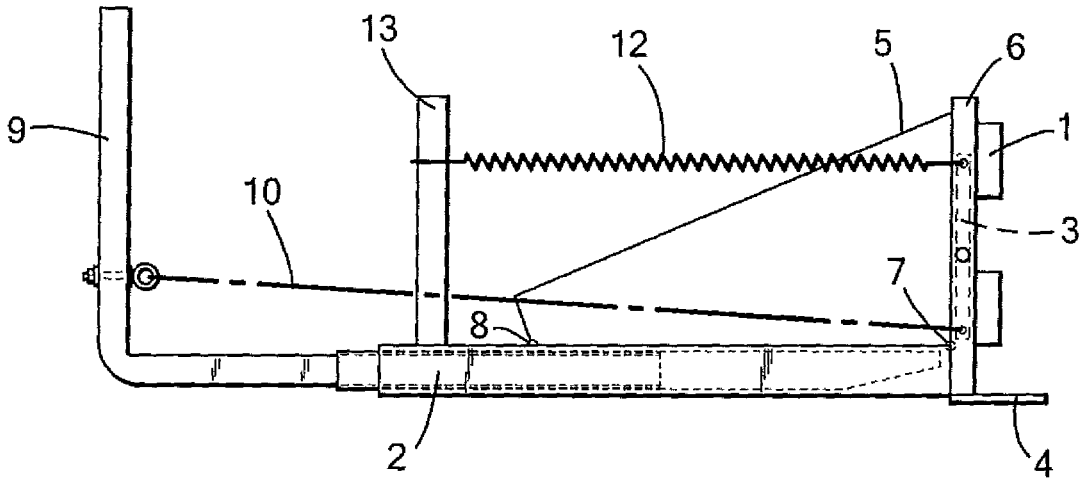
Figure 8:
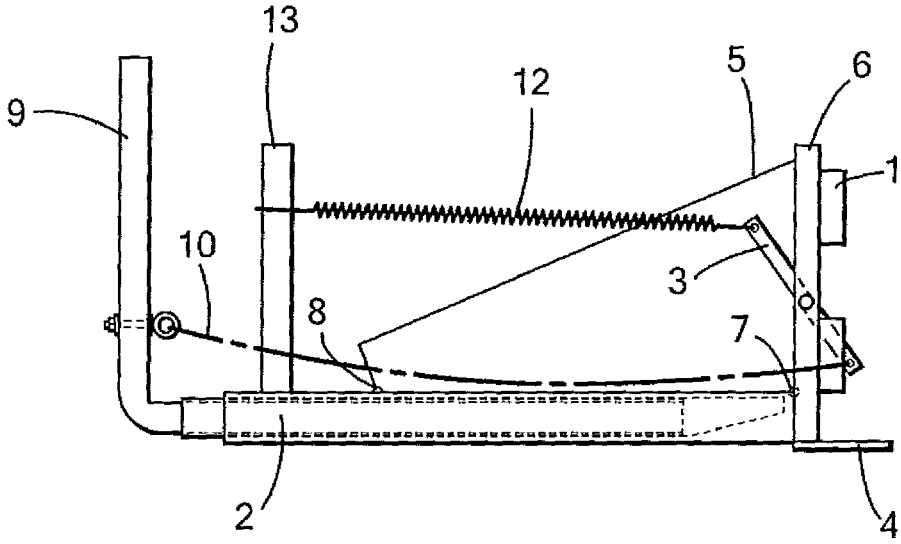

FIGS. 7 and 8 also illustrate an embodiment of the device equipped with a spring 12 and line 10 corresponding to those in FIGS. 5 and 6, with other components corresponding to that illustrated in FIGS. 1-4. However, in this case the spring 12 is shown attached to the upper part of the trigger 3 and the line 10 attached to the lower part of the trigger 3. In FIG. 7 the forks are illustrated telescoped outwards, the line 10 is taut, the spring is stretched and the guide part 3 is located in a position where the object is secured. In FIG. 8 the forks are illustrated in a retracted state, the spring 12 has pulled the trigger 3 into a position where an object that is fixed to the magnets 1 will be released.

A person skilled in the art will appreciate that many types of spring arrangements will be suitable for achieving the securing and release of the object relative to the securing device according to the invention as indicated in the attached patent claims.

The invention claimed is:

1. A lifting device for lifting, moving and stacking an object of a white goods type, the lifting device being adapted for mounting on an implement carrier comprising a fork structure which can be telescoped between a retracted position and an extended position, the lifting device comprising:

a carrier part comprising sleeves mountable on the fork structure of the implement carrier, a holding part which is attached to the carrier part, the holding part being provided with at least one permanent magnet which is capable of holding and lifting said object due to attractive magnetic forces between the at least one permanent magnet and a surface of said object, a guide part which is rotatably mounted to the holding part between a position where the object is secured and a position where the object is released, a fixed connection attachable to a stationary part of the fork structure and the guide part such that the fixed connection causes the guide part to rotate when the telescopic fork structure is extended from the retracted position, where, on being rotated when the object is held by the at least one permanent magnet, the guide part pushes said object away from the at least one permanent magnet to a distance beyond the effective range of influence of the at least one permanent magnet causing said object to be released from the at least one permanent magnet.

2. A device according to claim 1, wherein one or more supporting edges are removably mounted in the lower edge of the holding part.

3. A device according to claim 1, wherein the holding part is oriented vertically relative to the carrier part and/or that the holding part is mounted rotatably on the carrier part, thus enabling the holding part to be moved to another desired position and fixed in this new position.

4. A device according to claim 1, wherein the fixed connection comprises a line.

5. A lifting device for lifting, moving and stacking an object of a white goods type, the lifting device being adapted for mounting on an implement carrier comprising a fork structure which can be telescoped between a retracted position and an extended position, the lifting device comprising:

a carrier part comprising sleeves mountable on the fork structure of the implement carrier, a holding part which is attached to the carrier part, the holding part being provided with at least one permanent magnet which is capable of holding and lifting said object due to attractive magnetic forces between the at least one permanent magnet and a surface of said object, a guide part which is rotatably mounted to the holding part between a position where the object is secured and a position where the object is released, a spring which is attached to the guide part and a holder on the carrier part such that the spring causes the guide part to rotate when the telescopic fork structure is retracted from the extended position, a fixed connection attachable to a stationary part of the fork structure and the guide part such that the fixed connection causes the guide part to rotate when the telescopic fork structure is extended from the retracted position, thereby stretching said spring, where, on being rotated when the object is held by the at least one permanent magnet, the guide part pushes said object away from the at least one permanent magnet to a distance beyond the effective range of influence of the at least one permanent magnet causing said object to be released from the at least one permanent magnet.

6. A device according to claim 5, wherein the fixed connection comprises a line.

* * * * *